US009060569B2

(12) United States Patent
Auger et al.

(10) Patent No.: US 9,060,569 B2
(45) **Date of Patent: *Jun. 23, 2015**

(54) FOOTWEAR COMPONENT FOR AN ARTICLE OF FOOTWEAR

(71) Applicant: Nike, Inc., Beaverton, OR (US)

(72) Inventors: Perry W. Auger, Tigard, OR (US); Neil Crumbleholme, Lake Oswego, OR (US); Deliang Gu, Guangzhou (CN)

(73) Assignee: NIKE, Inc., Beaverton, OR (US)

( * ) Notice: Subject to any disclaimer, the term of this patent is extended or adjusted under 35 U.S.C. 154(b) by 18 days.

This patent is subject to a terminal disclaimer.

(21) Appl. No.: 13/911,432

(22) Filed: Jun. 6, 2013

(65) Prior Publication Data

US 2013/0333241 A1 Dec. 19, 2013

Related U.S. Application Data

(62) Division of application No. 12/702,980, filed on Feb. 9, 2010, now Pat. No. 8,479,416.

(51) Int. Cl.

| | |
|---|---|
| ***A43B 13/38*** | (2006.01) |
| ***A43B 13/18*** | (2006.01) |
| ***A43B 7/14*** | (2006.01) |
| ***A43B 13/04*** | (2006.01) |
| ***A43B 13/12*** | (2006.01) |
| ***A43B 13/14*** | (2006.01) |

(Continued)

(52) U.S. Cl.

CPC ..... *A43B 13/386* (2013.01); *A43B 7/1445* (2013.01); *A43B 13/04* (2013.01); *A43B 13/12* (2013.01); *A43B 13/141* (2013.01); *A43B 13/41* (2013.01); *A43B 17/003* (2013.01)

(58) Field of Classification Search

CPC .... A43B 13/026; A43B 13/12; A43B 13/141; A43B 13/386; A43B 13/41

USPC ..... 36/44, 102, 30 R, 91, 107, 25 R

See application file for complete search history.

(56) References Cited

U.S. PATENT DOCUMENTS

| | | | |
|---|---|---|---|
| 830,250 | A | 9/1906 | Preble |
| 1,184,720 | A | 5/1916 | Brogan |
| 1,236,528 | A | 8/1917 | Alberts |

(Continued)

FOREIGN PATENT DOCUMENTS

| | | | |
|---|---|---|---|
| CN | 102858196 | A | 1/2013 |
| DE | 19503308 | | 8/1996 |

(Continued)

OTHER PUBLICATIONS

Invitation to Pay Additional Fees and, Where Applicable, Protest Fee mailed Jun. 22, 2011 in International Application No. PCT/US2011/024033.

(Continued)

*Primary Examiner* — Ted Kavanaugh

(74) *Attorney, Agent, or Firm* — Plumsea Law Group, LLC

(57) ABSTRACT

A footwear component and a method of making the footwear component are disclosed. The footwear component includes a first portion and a second portion that are joined at a transition zone. The first portion and the second portion have different flexibility characteristics. The footwear component can bend at the transition zone to accommodate the natural bending of a foot.

20 Claims, 14 Drawing Sheets

(51) Int. Cl.
*A43B 13/41* (2006.01)
*A43B 17/00* (2006.01)

(56) References Cited

U.S. PATENT DOCUMENTS

| | | | | |
|---|---|---|---|---|
| 1,242,363 | A | 10/1917 | Mueller et al. | |
| 1,620,797 | A | 3/1927 | Bonaventure | |
| 1,697,589 | A | 1/1929 | Cort | |
| 2,064,507 | A | 12/1936 | Van Sant | |
| 2,090,065 | A | 8/1937 | Parker | |
| 2,760,281 | A | 8/1956 | Cosin | |
| 3,561,141 | A | 2/1971 | Brown | |
| 3,643,353 | A | 2/1972 | Weight | |
| 4,262,435 | A | 4/1981 | Block et al. | |
| 4,291,428 | A | 9/1981 | Anzani | |
| 4,364,188 | A * | 12/1982 | Turner et al. | 36/31 |
| 4,510,700 | A | 4/1985 | Brown | |
| 4,616,431 | A | 10/1986 | Dassler | |
| 5,042,100 | A | 8/1991 | Bar et al. | |
| 5,077,915 | A | 1/1992 | Gross | |
| 5,086,574 | A | 2/1992 | Bacchiocchi | |
| 5,095,570 | A | 3/1992 | Bar et al. | |
| 5,285,583 | A | 2/1994 | Aleven | |
| 5,435,078 | A | 7/1995 | Pyle | |
| 5,732,481 | A | 3/1998 | Farhad | |
| 6,061,929 | A * | 5/2000 | Ritter | 36/107 |
| 6,176,025 | B1 | 1/2001 | Patterson et al. | |
| 6,408,543 | B1 | 6/2002 | Erickson et al. | |
| 6,519,874 | B1 | 2/2003 | Dean | |
| 7,017,218 | B2 | 3/2006 | Nguyen | |
| 7,373,740 | B2 | 5/2008 | Lo | |
| 7,392,604 | B2 * | 7/2008 | Greene et al. | 36/97 |
| 7,401,422 | B1 | 7/2008 | Scholz et al. | |
| 7,421,808 | B2 | 9/2008 | Baier et al. | |
| 7,461,470 | B2 | 12/2008 | Dardinski et al. | |
| 7,614,164 | B2 | 11/2009 | Morales et al. | |
| 8,479,416 | B2 * | 7/2013 | Auger et al. | 36/102 |
| 2005/0060909 | A1 | 3/2005 | Kerns et al. | |
| 2006/0277795 | A1 | 12/2006 | Baier et al. | |
| 2006/0277799 | A1 | 12/2006 | Lebo | |
| 2011/0192049 | A1 | 8/2011 | Auger et al. | |

FOREIGN PATENT DOCUMENTS

| | | |
|---|---|---|
| EP | 2533660 | 12/2012 |
| JP | 52000556 | 1/1977 |
| WO | 2009019565 | 2/2009 |
| WO | 2011100236 | 8/2011 |

OTHER PUBLICATIONS

International Search Report and the Written Opinion, mailed Aug. 31, 2011, in PCT Application No. PCT/US2011/024033.

International Preliminary Report on Patentability (including Written Opinion of the ISA) mailed Aug. 23, 2012, in International Application No. PCT/US2011/024033.

* cited by examiner

FOOTWEAR COMPONENT FOR AN ARTICLE OF FOOTWEAR

This application is a Division of U.S. application Ser. No. 12/702,980 entitled "Footwear Component For An Article Of Footwear," filed on Feb. 9, 2010, allowed Mar. 8, 2013, and now U.S. Pat. No. 8,479,416, the disclosure of which is hereby incorporated by reference in its entirety.

BACKGROUND

The present invention relates generally to an article of footwear, and in particular to a footwear component for an article of footwear.

Inserts for articles of footwear have been previously proposed. Cort (U.S. Pat. No. 1,697,589) teaches a shoe with an inner sole blank. Cort teaches that the inner sole blank is first split from its heel end to form lower and upper laminations. A cushioning member comprises a soft sponge rubber and is inserted into the split.

Dardinski et al. (U.S. Pat. No. 7,461,470) teaches a shoe footbed system. Dardinski teaches a footbed that can include a stiffening member. The stiffening member can be made from one or more different materials including thermoplastic urethane (TPU), EVA or nylon.

The related art lacks provisions for accommodating the natural bending of the foot, especially near the toes of the foot. There is a need for a design that addresses this problem of the related art.

SUMMARY

In one aspect, a footwear component for an article of footwear, comprising: a longitudinal direction extending along a length of the footwear component; a first portion and a second portion, the second portion being disposed rearwardly of the first portion in the longitudinal direction; the footwear component comprising a first material and a second material that is different from the first material; the first portion being constructed of the first material and being substantially monolithic; the second portion comprising an upper layer, an intermediate layer and a lower layer, the intermediate layer being disposed between the upper layer and the lower layer, the intermediate layer being distal to the upper layer and the lower layer being distal to the intermediate layer; the intermediate layer being constructed of the first material and the upper layer and the lower layer being constructed of the second material; and where the first portion is substantially more flexible than the second portion.

In another aspect, the invention provides a method of making a footwear component for an article of footwear, comprising the steps of: reducing the thickness of a portion of a flexible member to form an intermediate layer; forming an upper layer on the intermediate layer and forming a lower layer on the intermediate layer using a second material that is different from a first material used to construct the flexible member; the upper layer, the intermediate layer and the lower layer being associated with a second portion of the footwear component that is disposed rearwardly of a first portion; a first thickness of the first portion being substantially similar to a second thickness of the second portion in a transition zone where the first portion and the second portion are connected; and where the first portion is substantially more flexible than the second portion.

In another aspect, the invention provides a method of making a customized footwear component for an article of footwear, comprising the steps of: receiving information related to user selected transition zone; forming a transition zone on the footwear component corresponding the user selected transition zone, the transition zone separating a first portion of the footwear component from a second portion of the footwear component that is disposed rearwardly of the first portion; and where the first portion has a substantially different rigidity than the second portion.

In one aspect, the invention provides a footwear component for an article of footwear, comprising: a longitudinal direction extending along a length of the footwear component; a first portion and a second portion, the second portion being disposed rearwardly of the first portion in the longitudinal direction; the footwear component comprising a first material and a second material that is different from the first material; the first portion being constructed of the first material and being substantially monolithic; the second portion comprising an upper layer, an intermediate layer and a lower layer, the intermediate layer being disposed between the upper layer and the lower layer, the intermediate layer being distal to the upper layer and the lower layer being distal to the intermediate layer; the intermediate layer being constructed of the second material and the upper layer and the lower layer being constructed of the first material; the second portion comprising a central cavity that extends through the upper layer, the intermediate layer and the lower layer; an insert configured for insertion into the central cavity; and wherein the insert comprises a third material that is substantially different from the first material and the second material.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
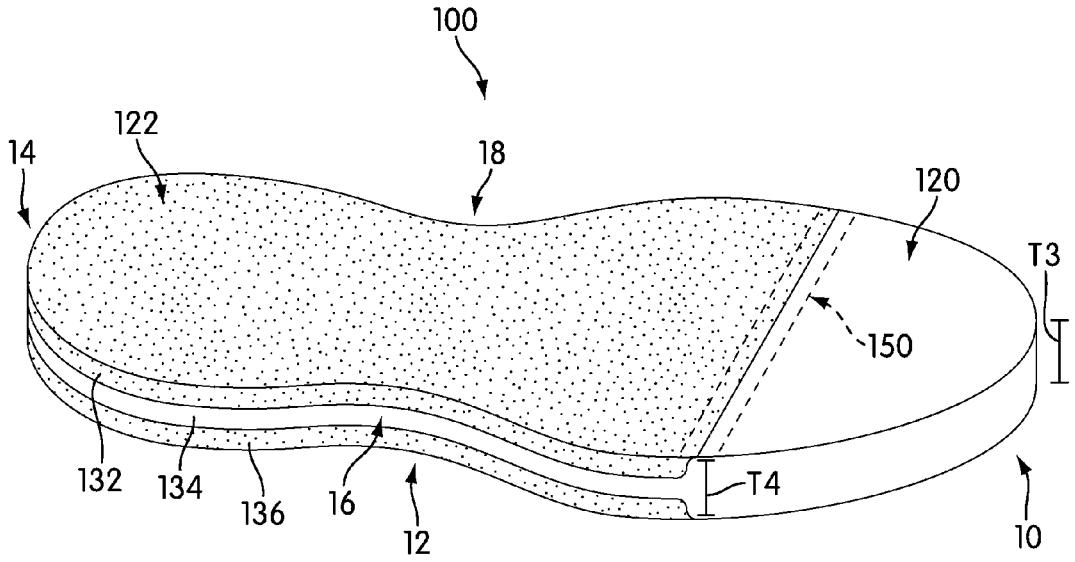
FIG. 1 is an isometric view of an embodiment of a footwear component for an article of footwear.

FIG. 1 illustrates an embodiment of footwear component 100. The term "footwear component" as used throughout this detailed description and in the claims refers to any component of an article of footwear. In one embodiment, a footwear component could be an insole. In another embodiment, a footwear component could be another type of insert. In an exemplary embodiment, a footwear component could be a lasting board. It should be understood that the principles taught in this detailed description could also be applied to any other component of an article of footwear.

For purposes of illustration, footwear component 100 is shown in isolation in the current embodiment. In other embodiments, however, footwear component 100 may be associated with an article of footwear. Generally, footwear component 100 may be used with any type of footwear including, but not limited to: hiking boots, soccer shoes, football shoes, sneakers, rugby shoes, basketball shoes, baseball shoes as well as other kinds of shoes. As shown in the Figures, footwear component 100 is intended to be used with a right article of footwear; however, it should be understood that the following discussion may equally apply to a mirror image of footwear component 100 that is intended for use with a left article of footwear.

For purposes of reference, footwear component 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, footwear component 100 may include lateral side 16 and medial side 18. In particular, lateral side 16 and medial side 18 may be opposing sides of footwear component 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of footwear component 100. Likewise, lateral side 16 and medial side 18 are intended to represent generally two sides of a component, rather than precisely demarcating footwear component 100 into two halves. In addition, forefoot portion 10, midfoot portion 12 and heel portion 14, as well as lateral side 16 and medial side 18, can also be applied to individual portions of a footwear component.

For consistency and convenience, directional adjectives are employed throughout this detailed description corresponding to the illustrated embodiments. The term "longitudinal" as used throughout this detailed description and in the claims refers to a direction extending a length of a footwear component. In some cases, the longitudinal direction may extend from a forefoot portion to a heel portion of the footwear component. Also, the term "lateral" as used throughout this detailed description and in the claims refers to a direction extending a width of a footwear component. In other words, the lateral direction may extend between a medial side and a lateral side of a footwear component. Furthermore, the term "vertical" as used throughout this detailed description and in the claims refers to a direction generally perpendicular to a lateral and longitudinal direction. For example, in cases where an article of footwear is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual portions of a footwear component.

A footwear component can include provisions for tuning the flexibility of an article of footwear. In some cases, a footwear component can comprise distinct portions having different levels of flexibility. In an exemplary embodiment, a footwear component can comprise two distinct portions that have different flexibility properties.

In the current embodiment, footwear component 100 includes first portion 120 and second portion 122 that is disposed rearwardly of first portion 120 in the longitudinal direction. In some cases, first portion 120 may have a first rigidity and second portion 122 may have a second rigidity. In one embodiment, first portion 120 may be substantially less rigid than second portion 122. In other words, first portion 120 may be substantially more flexible than second portion 122. In other embodiments, however, second portion 122 may be less rigid than first portion 120.

In one embodiment, first portion 120 may comprise a substantially monolithic portion. In contrast, second portion 122 may comprise a substantially layered portion. In some cases, second portion 122 may comprise upper layer 132, lower layer 136 and intermediate layer 134 that is disposed between upper layer 132 and lower layer 136. In some cases, upper layer 132 may be proximal to intermediate layer 134 and lower layer 136. Likewise, intermediate layer 134 may be proximal to lower layer 136. With this arrangement, lower layer 136 may be disposed closer to a ground engaging surface, while upper layer 132 may be disposed closer to a foot.

First portion 120 may be made of a first material. Similarly, intermediate layer 134 of second portion 122 may be made of the first material. In some cases, intermediate layer 134 may be integrally formed with first portion 120. In contrast, second portion 122 may comprise at least two distinct materials. For example, in one embodiment, second portion 122 may comprise the first material and a second material that is substantially different from the first material. In particular, intermediate layer 134 may be made of the first material, while upper layer 132 and lower layer 136 may be made of the second material. In still other embodiments, upper layer 132 and lower layer 136 could be made of substantially different materials from one another. In other words, in other embodiments, second portion 122 could comprise three or more distinct materials. In still another embodiment, upper layer 132, intermediate layer 134 and lower layer 136 could all comprise substantially similar materials.

First portion 120 and second portion 122 may be generally connected at transition zone 150. The term "transition zone" as used throughout this detailed description and in the claims, refers to transition region between first portion 120 and second portion 122. In particular, transition zone 150 is a zone where the flexibility of footwear component 100 changes substantially between first portion 120 and second portion 122. Transition zone 150 generally extends between lateral side 16 and medial side 18 and has small width extending approximately in the longitudinal direction. In other words, the flexibility and/or rigidity characteristics of footwear component 100 may change gradually between first portion 120 and second portion 122 across the width of transition zone 150.

In some embodiments, transition zone 150 may serve as a flexing region, about which first portion 120 may flex with respect to second portion 122. In some cases, transition zone 150 could be aligned with natural bending regions of a foot. For example, in one embodiment, transition zone 150 could be approximately aligned with the region between the proximal phalanges and metatarsals of the foot. With this arrangement, first portion 120 may bend with the toes of the foot about second portion 122 to accommodate the natural bending of the foot during use.

In different embodiments, the thickness of footwear component 100 can vary. In some embodiments, the thickness of footwear component 100 can be substantially constant along the longitudinal direction. In other embodiments, the thickness of footwear component 100 can vary. As an example, the thickness of footwear component 100 may vary between first portion 120 and second portion 122. Moreover, in some cases, the thickness of first portion 120 may remain substantially constant, while the thickness of second portion 122 may increase between midfoot portion 12 and heel portion 14.

In an exemplary embodiment, the thickness of first portion 120 and second portion 122 may remain substantially similar throughout transition zone 150 to facilitate a strong connection between first portion 120 and second portion 122. For example, in the current embodiment, first portion 120 may have thickness T3. In addition, within transition zone 150 footwear component 100 has thickness T4 which is substantially similar to thickness T3. In other cases, however, thickness T4 could be substantially greater than thickness T3. In still other cases, thickness T4 could be substantially less than thickness T3.

FIGS. 2 through 6 illustrate an embodiment of a method of making a footwear component. In this embodiment, the following steps may be performed by any proprietor configured to manufacture and/or sell an article of footwear. A proprietor may include one or more factories, multiple offices, retailers and various other establishments associated with a business. Generally, the term "proprietor," as used here, may also refer to distributors and/or suppliers. In other words, the term proprietor may also apply to various operations on the manufacturing side, including the operations responsible for parts, labor, and/or retail of the article of footwear, as well as other manufacturing side operations. In addition, it will be understood that in other embodiments one or more of the following steps may be optional.

Figure 2:
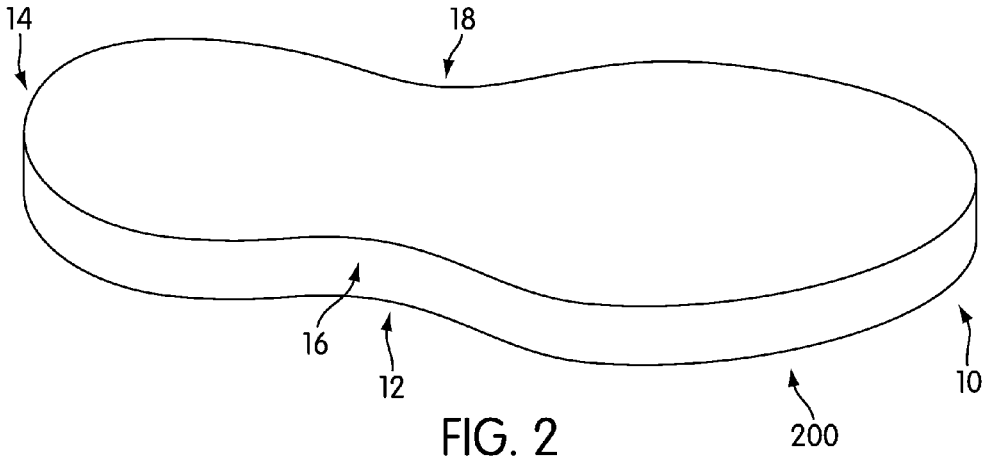
FIG. 2 is an isometric view of an embodiment of a flexible member used for making a footwear component.

Referring to FIG. 2, a first step in making a footwear component can include receiving flexible member 200. Flexible member 200 may have a geometry that corresponds to the approximate shape of a bottom surface of a foot. In particular, flexible member 200 may be provided with a geometry that is used with insoles, inserts, lasting boards as well as other components of an article of footwear. In addition, flexible member 200 can have any thickness. In some cases, the thickness of flexible member 200 may be chosen according to the desired thickness of a first portion of a footwear component.

Flexible member 200 can comprise any substantially flexible material. In some cases, flexible member 200 can be made of a non-woven material. Examples of non-woven materials include non-woven fabrics such as felt. In other cases, flexible member 200 can be made of any other material that can undergo various kinds of deformation including cutting, shearing, compression or any other kind of deformation. In another embodiment, flexible member 200 could be made of a substantially flexible plastic material.

Figure 3:
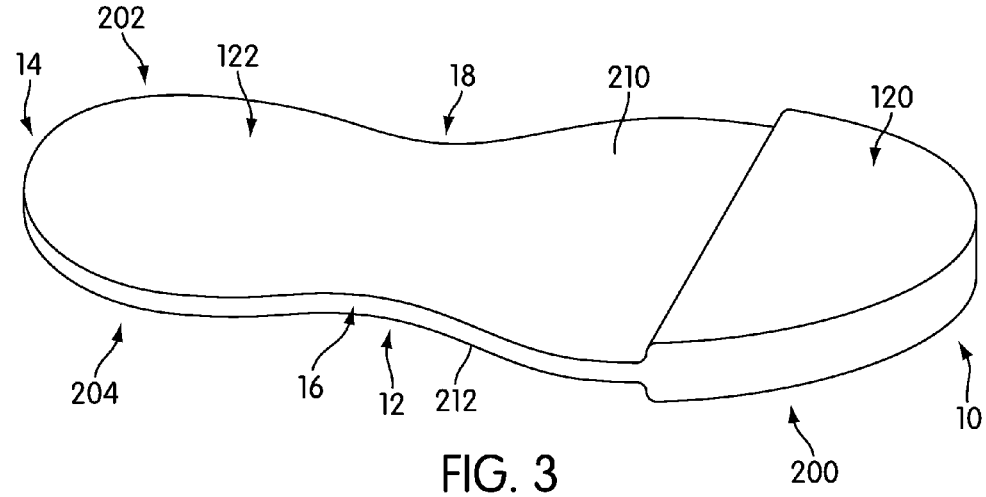
FIG. 3 is an isometric view of an embodiment of a step in a method of making a footwear component.
Figure 4:
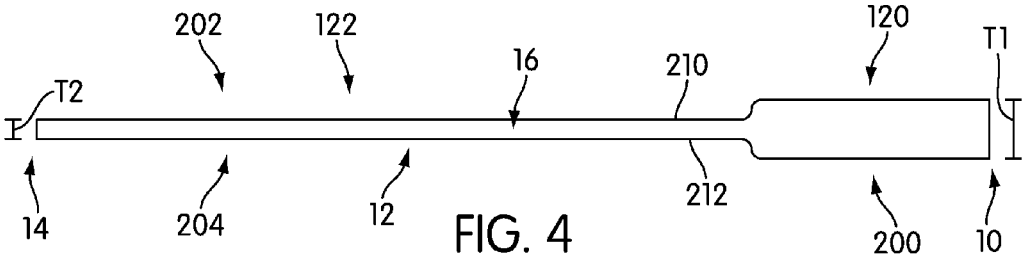
FIG. 4 is a side view of an embodiment of a step in a method of making a footwear component.

FIGS. 3 and 4 illustrate a step of modifying flexible member 200. In some embodiments, a method of making a footwear component may include a step of reducing the thickness of a portion of flexible member 200. In an exemplary embodiment, the method can include a step of reducing the thickness of a portion of flexible member 200. Generally, the thickness of a portion of flexible member 200 can be reduced in various ways. In one embodiment, material can be removed from upper portion 202 of flexible member 200 and lower portion 204. In some cases, material can be cut, shaved or skived from upper portion 202 and/or lower portion 204. In other embodiments where flexible member 200 comprises a compressible material, a portion of flexible member 200 can be substantially permanently compressed.

In the exemplary embodiment, the thickness of a portion of flexible member 200 may be reduced to form intermediate layer 134. In this case, intermediate layer 134 may be associated with second portion 122 of flexible member 200, which extends rearwardly from first portion 120. This arrangement provides flexible member 200 with upper recessed portion 210 and lower recessed portion 212. Moreover, in the current embodiment, first portion 120 may retain a thickness T1 which is associated with the original thickness of flexible member 200, while intermediate layer 134 may be associated with a thickness T2 that is substantially less than thickness T1. It will be understood that in different embodiments, thickness T1 and thickness T2 can have any values. In some cases, by modifying the values of thickness T1 and thickness T2, the relative rigidity of first portion 120 and second portion 122 can be varied.

Figure 5:
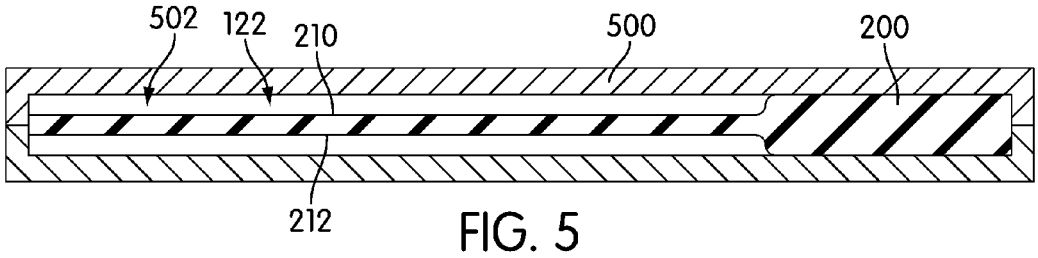
FIG. 5 is a cross-sectional view of an embodiment of a step of molding a portion of a footwear component.
Figure 6:
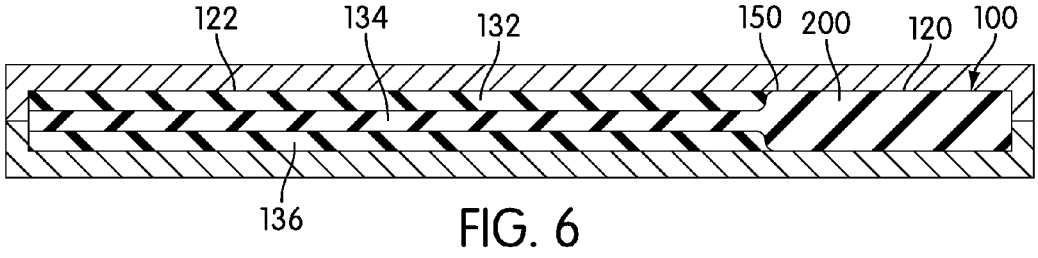
FIG. 6 is a cross-sectional view of an embodiment of a step of molding a portion of a footwear component.

FIGS. 5 and 6 illustrate embodiments of steps for forming upper and lower layers within second portion 122. In an exemplary embodiment, a second material may be molded to upper recessed portion 210 and lower recessed portion 212 of second portion 122. However, in other embodiments, upper and lower layers can be formed within second portion 122 in various ways. For example, in another embodiment, preformed portions can be attached to second portion 122 at upper recessed portion 210 and lower recessed portion 212 of flexible member 200.

Referring to FIG. 5, flexible member 200 may be placed inside mold 500. In some cases, mold 500 may include internal cavity 502 that has a similar shape to flexible member 200. Furthermore, internal cavity 502 may be shaped to provide space for filling upper recessed portion 210 and lower recessed portion 212 with molding material. Referring to FIG. 6, a second material may be poured into mold 500 to form upper layer 132 and lower layer 136 of second portion 122. In particular, upper layer 132 and lower layer 136 may sandwich intermediate layer 134 of flexible member 200. It will be understood that in this embodiment the geometry of upper layer 132 and lower layer 136 can be varied by varying the geometry of cavity 502. In some cases, for example, cavity 502 could be provided with a greater thickness around second portion 122 in order to form thicker upper and lower layers. As previously discussed, in an exemplary embodiment, upper layer 132 and lower layer 136 may be molded in a manner so that the thickness of footwear component 100 within transition zone 150 is approximately equal to the thickness of first portion 120.

As previously discussed, the exemplary embodiment uses a second material for upper layer 132 and lower layer 136 that are substantially different than the first material comprising first portion 120 and intermediate layer 134 of second portion 122. Furthermore, the first material, which comprises flexible member 200, may be made of a substantially flexible material such as a non-woven material or any other substantially flexible material. Generally the second material may be selected to have a greater rigidity than the first material, and thus the second material may be less flexible than the first material. Examples of materials that could be used for the second material include, but are not limited to, polymers, metals, woven and non-woven fabrics, composite materials as well as any other materials. In an exemplary embodiment, the second material may be made of thermoplastic polyurethane (TPU). In other embodiments, however, the second material could be less rigid than the first material or have a substantially similar rigidity to the first material. In cases where the rigidities of the two materials are not substantially different, the rigidities of first portion 120 and second portion 122 can be tuned by varying the layered structure of second portion 122.

Figure 7:
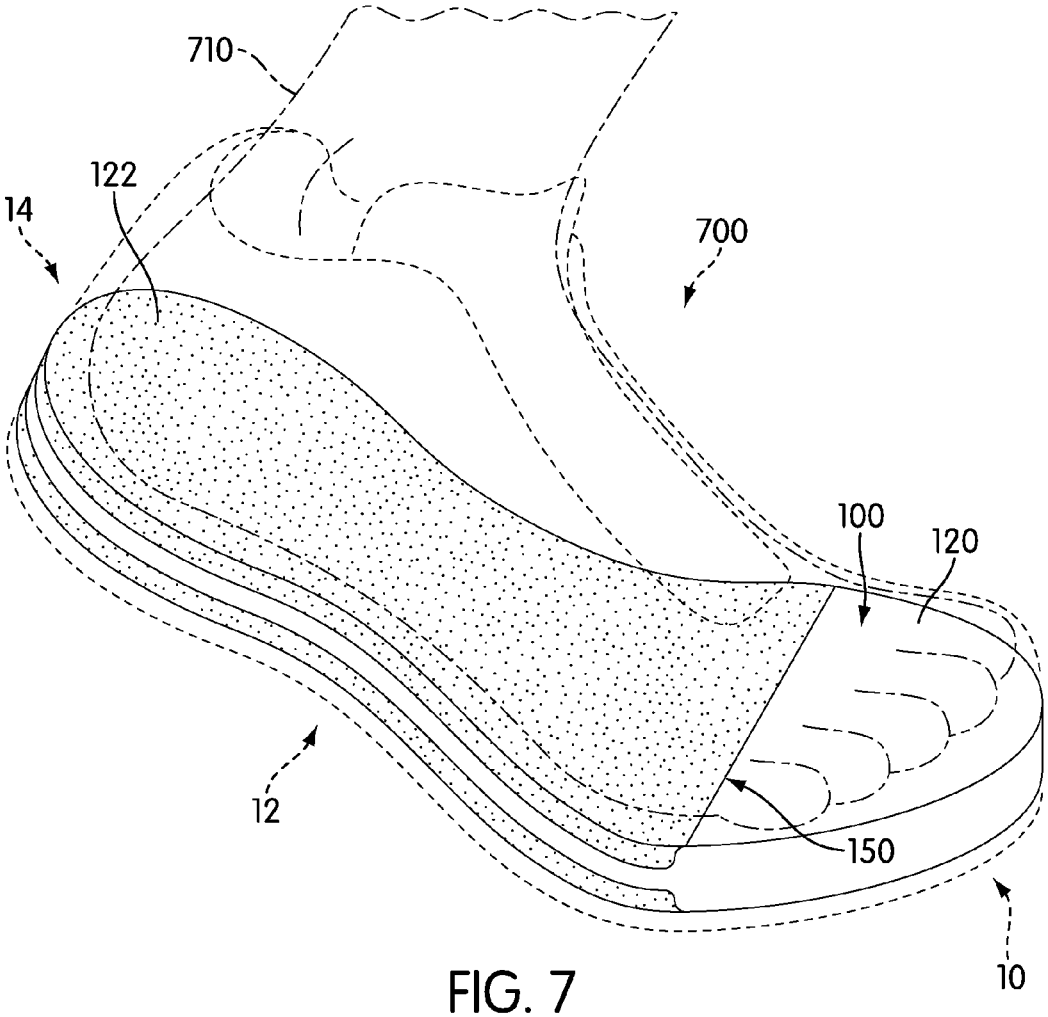
FIG. 7 is an isometric view of an embodiment of a footwear component bending with a foot.

FIG. 7 illustrates a schematic view of an embodiment of footwear component 100 undergoing bending. For purposes of clarity, article of footwear 700 and foot 710 are shown in phantom. In this case, footwear component 100 is disposed in a position within article of footwear 700 to serve as an insert, insole or lasting board. In other embodiments, footwear component 100 can be disposed in other portions of an article of footwear.

As illustrated, footwear component 100 is configured to bend at transition zone 150, which is approximately aligned with the natural bending region of foot 710 associated with the joints between the proximal phalanges and metatarsals of the foot. In this case, the front of forefoot portion 10 of article 700 remains planted on the ground, with midfoot portion 12 and heel portion 14 raised up as foot 710 undergoes some bending associated with the toes. In other words, transition zone 150 acts in a hinge-like manner to accommodate the bending of foot 710 and provide for a more natural motion during use of article 700.

In some embodiments, the location of transition zone 150 could vary. In some cases, transition zone 150 could be disposed in forefoot portion 10. In other cases, transition zone 150 could be disposed in midfoot portion 12. In still other cases, transition zone 150 could be disposed in heel portion 14. By varying the location of transition zone 150, the flexibility of different regions of footwear component 100 can vary.

Figure 8:
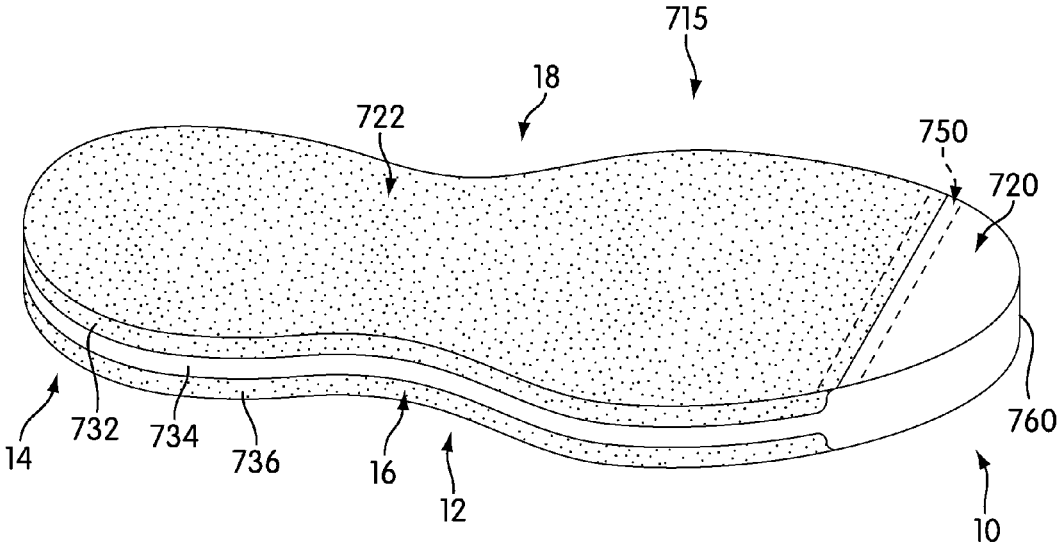
FIG. 8 is an isometric view of another embodiment of a footwear component for an article of footwear.

FIG. 8 illustrates a schematic view of another embodiment of footwear component 715. In this embodiment, footwear component 715 includes first portion 720 and second portion 722 that is disposed rearwardly of first portion 720 in the longitudinal direction. In some cases, first portion 720 may have a first rigidity and second portion 722 may have a second rigidity. In one embodiment, first portion 720 may be substantially less rigid than second portion 722. In other words, first portion 720 may be substantially more flexible than second portion 722. In other embodiments, however, second portion 722 may be less rigid than first portion 720.

In one embodiment, first portion 720 may comprise a substantially monolithic portion. In contrast, second portion 722 may comprise a substantially layered portion. In some cases, second portion 722 may comprise upper layer 732, lower layer 736 and intermediate layer 734 that is disposed between upper layer 732 and lower layer 736. In some cases, upper layer 732 may be proximal to intermediate layer 734 and lower layer 736. Likewise, intermediate layer 734 may be proximal to lower layer 736. With this arrangement, lower layer 736 may be disposed closer to a ground engaging surface, while upper layer 732 may be disposed closer to a foot.

First portion 720 and second portion 722 may be generally connected at transition zone 750. In particular, transition zone 750 is a zone where the flexibility of footwear component 715 changes substantially between first portion 720 and second portion 722. Transition zone 750 generally extends between lateral side 16 and medial side 18 and has small width extending approximately in the longitudinal direction. In other words, the flexibility and/or rigidity characteristics of footwear component 715 may change gradually between first portion 720 and second portion 722 across the width of transition zone 750.

In the exemplary embodiment, transition zone 750 may be disposed at toe portion 760 of footwear component 715. In other words, second portion 722 extends throughout a substantial majority of forefoot portion 10. Moreover, transition zone 750 may be disposed substantially forwards of transition zone 150 of the previous embodiment. Using this arrangement, transition zone 750 may provide for increased flexibility at the forward most portion of footwear component 715.

Figure 9:
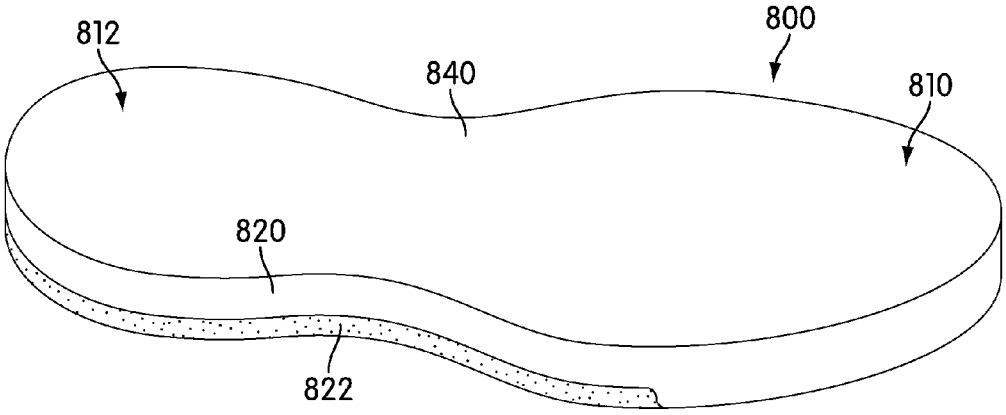
FIG. 9 is an isometric view of another embodiment of a footwear component.
Figure 10:
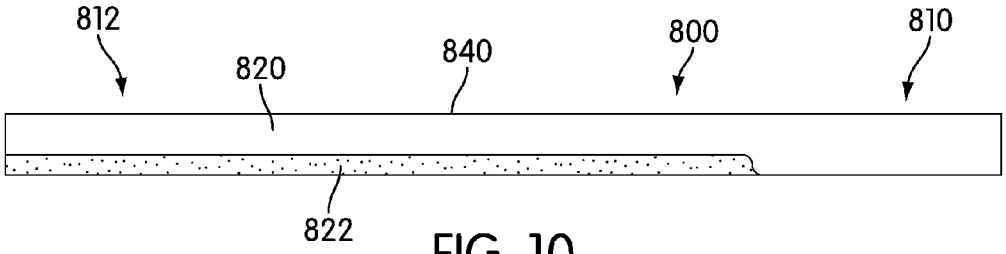
FIG. 10 is a side view of another embodiment of a footwear component.

FIGS. 9 and 10 illustrate another embodiment of a footwear component that can be used with an article of footwear. Referring to FIGS. 9 and 10, footwear component 800 has substantially similar features to the previous embodiment of a footwear component discussed above. For example, footwear component 800 includes first portion 810 and second portion 812 that have substantially different rigidities and flexibility properties. In contrast to the previous embodiment, second portion 812 comprises only two layers, including first layer 820 and second layer 822. In this case, first layer 820 is associated with flexible member 840 that comprises a majority of footwear component 800. Second layer 822, which is disposed distal to first layer 820, comprises a second material that is substantially different from a first material used to make flexible member 840. In an exemplary embodiment, the first material is a non-woven fabric and the second material is TPU. This two layer arrangement may provide for substantially different flexibility properties between first portion 810 and second portion 812 than the three layer arrangement discussed above. Moreover, this arrangement provides a substantially continuous upper surface for footwear component 800 that may increase comfort.

In still other embodiments, other layered arrangements for one or more portions of a footwear component could be used. For example, in another embodiment, a portion of a footwear component could comprise four or more layers which alternate between layers of a first material and a second material. By varying the number of layers as well as the material properties of each layer, the rigidity and flexibility characteristics of different portions of a footwear component can be fined tuned to accommodate bending of a foot.

A footwear component can include provisions for tuning the flexibility to accommodate variations in the anatomy of a foot. In some embodiments, the configuration of a transition zone can be changed to tune the flexibility properties of a footwear component. Specifically, in some cases, the location, orientation and/or shape of a transition zone can be changed.

Generally, a transition zone can have various configurations. In some embodiments, a transition zone can have a substantially linear configuration. For example, in some cases, a transition zone can be arranged as linear transition zone that is oriented in a substantially lateral direction. In other cases, a transition zone can be oriented in a substantially longitudinal direction or a diagonal direction. In other embodiments, however, a transition zone can be arranged in a substantially nonlinear configuration. For example, in some cases, a transition zone can have a generally wavy shape that extends between the lateral and medial sides of a footwear component. In other cases, a transition zone can be arranged in any other nonlinear configuration.

It will be understood that the term "nonlinear configuration" is not intended to be limited to a particular type of nonlinear shape or arrangement. For example, a nonlinear configuration for a transition zone can include smooth nonlinear shapes such as sinusoidal shapes, wavy shapes, as well as other smooth nonlinear shapes. Also, a nonlinear configuration for a transition zone can include polygonal nonlinear shapes with edges such as zig-zag shapes, triangle wave shapes, square wave shapes, as well as any other types of non-smooth nonlinear shapes. Furthermore, in some cases, a transition zone can be associated with a regular nonlinear configuration that includes repeating patterns. In other cases, however, a transition zone can be associated with an irregular nonlinear configuration that does not include repeating patterns. In still other cases, a transition zone can be associated with a nonlinear configuration that includes some portions with repeating patterns and other portions with non-repeating patterns. Still further, some transition zones can include nonlinear configurations that are symmetric about an axis of a footwear component. For example, in embodiments including a transition zone with a configuration that is sinusoidal, the transition zone may be substantially symmetric about a central longitudinal axis of the footwear component. In contrast, in other embodiments including transition zones with configurations that are irregular wave configurations, the transition zones may not be symmetric about any axis of the footwear component.

Figure 11:
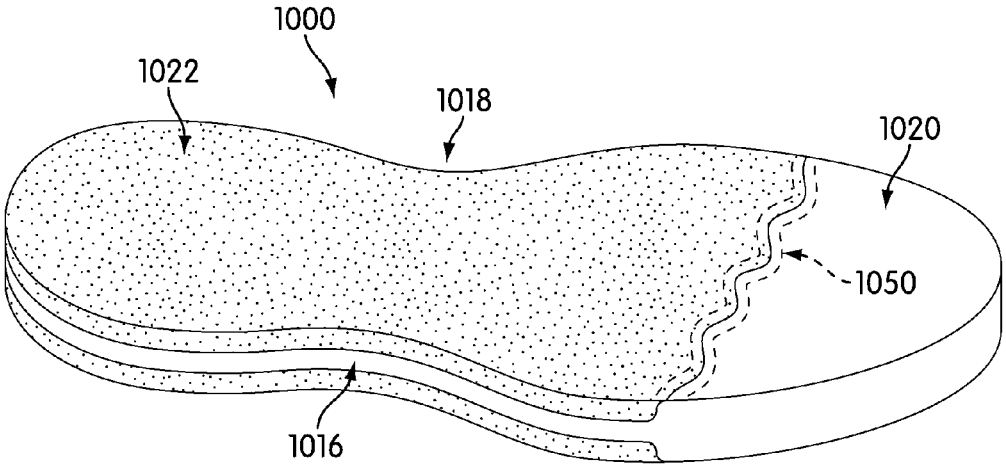
FIG. 11 is an isometric view of another embodiment of a footwear component.
Figure 12:
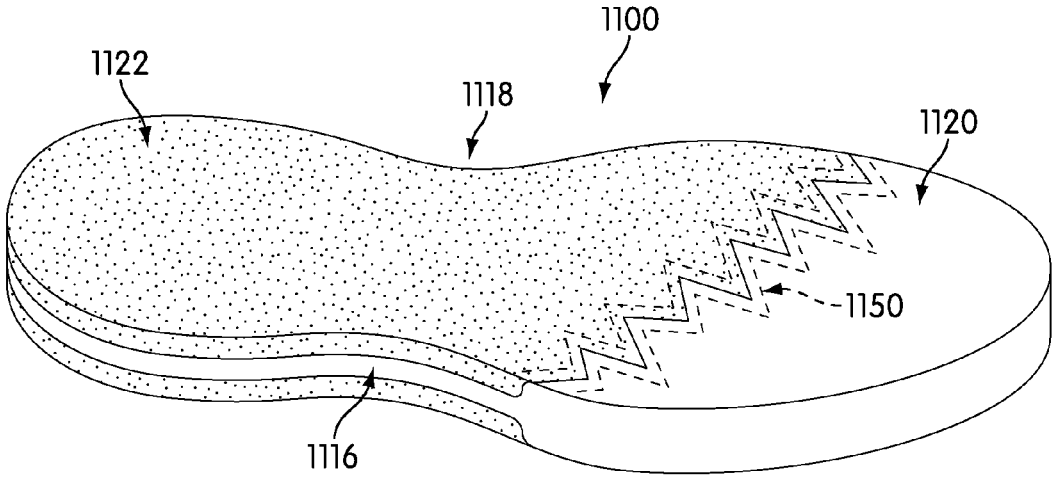
FIG. 12 is an isometric view of another embodiment of a footwear component.

FIGS. 11 and 12 illustrate other embodiments for configurations for a transition zone. Referring to FIG. 11, footwear component 1000 is provided with first portion 1020 and second portion 1022. First portion 1020 is a substantially monolithic portion and second portion 1022 has a layered construction. In addition, first portion 1020 may be substantially more flexible than second portion 1022.

First portion 1020 and second portion 1022 are connected at transition zone 1050. In this case, transition zone 1050 has a substantially nonlinear configuration. In particular, transition zone 1050 has a smooth wavy pattern that extends from lateral side 1016 to medial side 1018 of footwear component 1000. By using a nonlinear configuration the flexibility of transition zone 1050 can be modified from a transition zone having a substantially linear configuration.

Referring to FIG. 12, footwear component 1100 is provided with first portion 1120 and second portion 1122. First portion 1120 is a substantially monolithic portion and second portion 1122 has a layered construction. In addition, first portion 1120 may be substantially more flexible than second portion 1122. Furthermore, first portion 1120 and second portion 1122 are connected at transition zone 1150.

In this embodiment, transition zone 1150 has a nonlinear configuration. In particular, transition zone 1150 has a jagged irregular nonlinear configuration. In addition, the orientation and location of transition zone 1150 has been modified from the previous embodiments. In particular, transition zone 1150 has a substantially diagonal orientation from lateral side 1116 to medial side 1118 that is angled with respect to the lateral direction. This arrangement may be useful for accommodating bending in a foot with a bending region that is oriented in a substantially similar diagonal manner.

In some embodiments, a proprietor can provide a customization system that allows for the manufacturing of footwear components with customized transition zones that are tuned to accommodate the unique foot anatomies of various different users. In some cases, the customization system can include provisions that allow a user to design or select a transition zone. In an exemplary embodiment a customer may use a customization system to select the size, orientation and shape of a transition zone that best approximates the natural bending region of the foot of the user.

Figure 13:
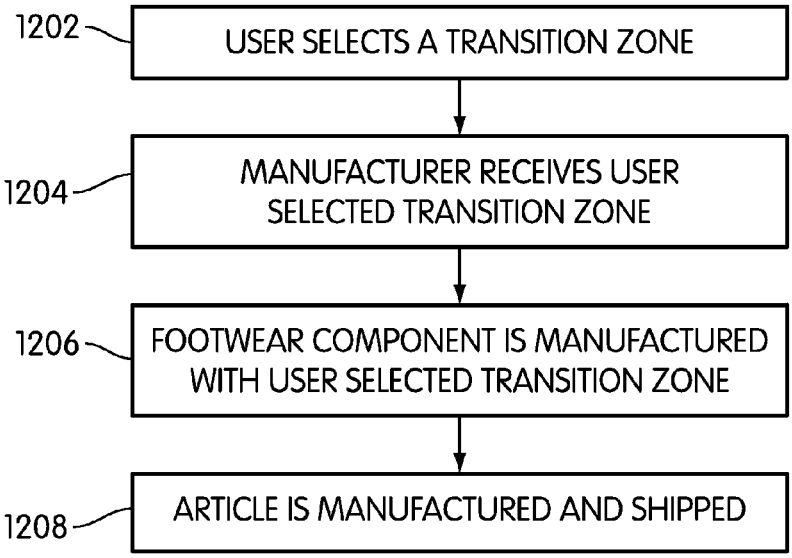
FIG. 13 is an embodiment of a process of customizing a footwear component.

FIG. 13 is an embodiment of a method for providing articles of footwear including footwear components with customized transition zones. During step 1202, a user may select a transition zone. In some cases, the user may select a predesigned transition zone. In other cases, the user may design a transition zone. Once the user has selected the transition zone, the manufacturer may receive the user selected transition zone during step 1204. Following this, a footwear component is manufactured with the user selected transition zone during step 1206. Finally, during step 1208, an article of footwear is assembled with the footwear component and shipped. In some cases, the article may be shipped to a predesignated address that may below to the user. In other cases, the article may be shipped to a retail store or another party.

Figure 14:
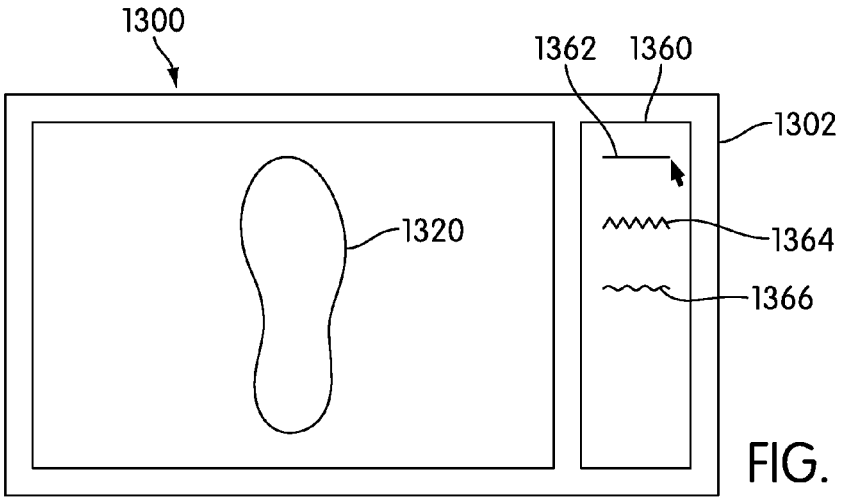
FIG. 14 is a schematic view of an embodiment of a method of customizing a footwear component.
Figure 15:
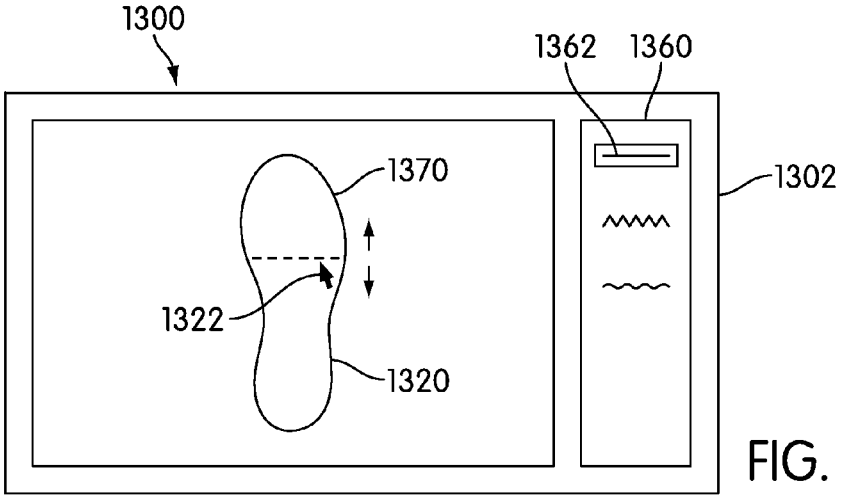
FIG. 15 is a schematic view of an embodiment of a method of customizing a footwear component.
Figure 16:
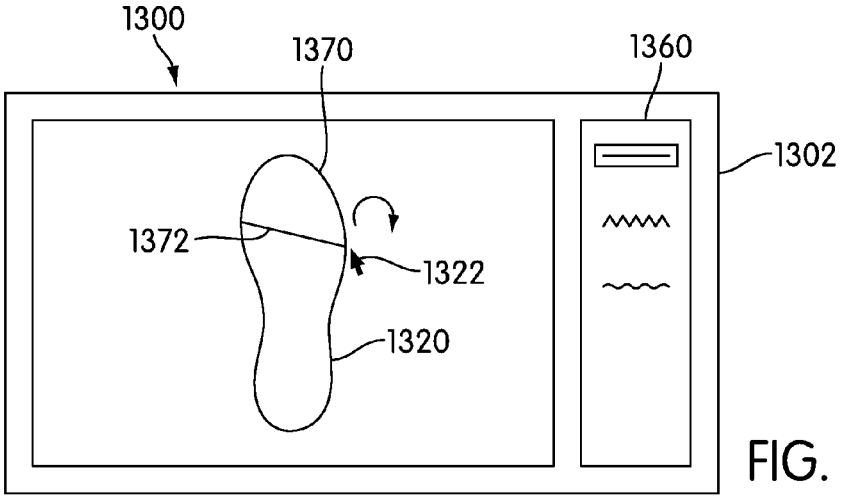
FIG. 16 is a schematic view of an embodiment of a method of customizing a footwear component.

FIGS. 14 through 16 illustrate embodiments of a step of selecting a transition zone. Referring to FIGS. 14 through 16, a customization system can include graphical interface system 1300 that allows a user to select a transition zone. In some cases, graphical interface system 1300 may be accessed on remote terminal 1302 through a website. In particular, in some cases, graphical interface system 1300 may be accessed through the internet or any other network. In other cases, graphical interface system 1300 may be associated with software that runs on remote terminal 1302. In addition, in some cases remote terminal 1302 could be located in a retail store. In other cases, remote terminal 1302 could be located in any other location. For example, in some cases, remote terminal 1302 may be a home computer.

Graphical interface system 1300 may include a footwear component representation 1320 that is a graphical representation of a footwear component. In addition, graphical interface system 1300 can include pointer 1322 and various menus for altering various characteristics of footwear component representation 1320. In addition, in some embodiments, graphical interface system 1300 can include other features for modifying footwear component representation 1320.

Examples of various features that may be associated with a graphical interface system are discussed in U.S. patent application Ser. No. 11/612,320, which was filed on Dec. 18, 2006, the entirety of which is hereby incorporated by reference.

Referring to FIG. 14, a user may select a transition zone shape from transition zone menu 1360. In this embodiment, three types of transition zone shapes are illustrated, including linear configuration 1362, jagged configuration 1364 and wavy configuration 1366. Referring to FIG. 15, after a user selects a transition zone configuration, the user can determine a location for the transition zone using pointer 1322. In this case, a user has selected linear configuration 1362 and is positioning the transition zone within forefoot portion 1370 of footwear component representation 1320. Next, as illustrated in FIG. 16, a user can choose the orientation of the transition zone. In this example, the user may rotate transition zone 1372 to form a diagonal linear transition zone configuration within forefoot portion 1370. With this arrangement, a user can select a transition zone that approximately corresponds to the size, shape and location of the bending region of the foot of the user. It will be understood that while this process is illustrated for a right footwear component, a user may also select a transition zone for a left footwear component in a similar manner.

A user may obtain information related to the size, shape and orientation of a bending region of a foot in any manner. In some cases, a proprietor may provide methods and/or specific measuring devices that provide bending region information. For example, in some cases the shape and geometry of the foot of a user can be measured at a retail store using footwear scanning technology. In other cases, a proprietor can provide instructions for taking measurements of a foot to obtain the necessary information for selecting a corresponding transition zone. Furthermore, while the current embodiment illustrates steps of manually selecting the shape, location and orientation of transition zones for a footwear component, other embodiments can include provisions for automatically selecting customized transition zones for a user according to various measurements of the foot or other anatomical properties of the foot of the user. Still further, in other cases, the transition zone configuration for a footwear component could be automatically selected according to the intended use of an article of footwear.

Figure 17:
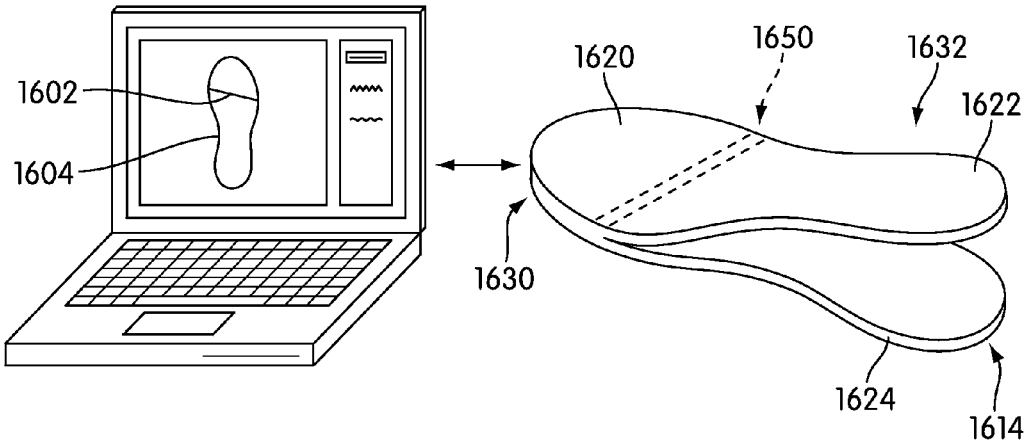
FIG. 17 is a schematic view of an embodiment of a step of cutting a flexible member to form a footwear component.
Figure 18:
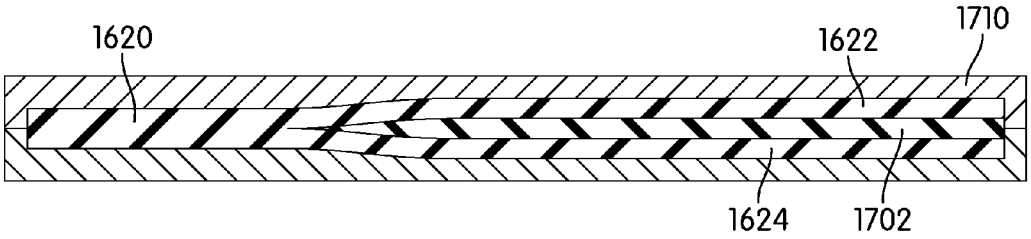
FIG. 18 is a cross-sectional view of an embodiment of a step of molding a layer in a footwear component.
Figure 19:
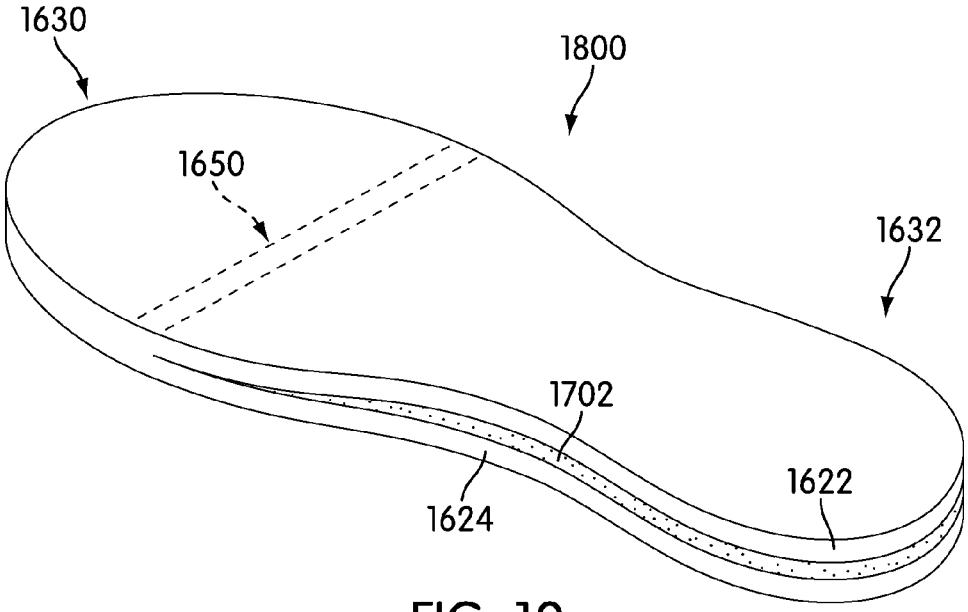
FIG. 19 is an isometric view of an embodiment of a footwear component.

FIGS. 17 through 19 illustrate an embodiment for manufacturing a footwear component including a user selected transition zone. The current embodiment illustrates an alternative construction for a footwear component having a first portion and a second portion of different rigidities. It should be understood, however, that in other embodiments a footwear component can be constructed using any techniques discussed above to form a customized footwear component with a user selected transition zone.

Referring to FIG. 17, a proprietor may determine the configuration for transition zone 1650 on flexible member 1620 according to user selected transition zone 1602 that is associated with footwear component representation 1604. In this case, transition zone 1650 has a linear shape and is oriented substantially diagonally across flexible member 1620. Moreover, transition zone 1650 divides first portion 1630 from second portion 1634 of flexible member 1620.

At this point, flexible member 1620 may be cut at second portion 1632 from heel portion 1614 to transition zone 1650. In particular, the cut may be made in a plane that extends through the longitudinal and lateral directions. This cutting acts to separate second portion 1632 of flexible member 1620 into upper layer 1622 and lower layer 1624. It will be understood that flexible member 1620 may be cut using any known methods including knives, laser cutting, saws, any types of blades as well as any other methods known in the art for cutting or separating a portion into distinct layers or laminates.

Next, as illustrated in FIG. 18, intermediate layer 1702 may be formed between upper layer 1622 and lower layer 1624. In an exemplary embodiment, intermediate layer 1702 may be molded between upper layer 1622 and lower layer 1624 using mold 1710. In other cases, however, intermediate layer 1702 could be a preformed portion that is bonded between upper layer 1622 and lower layer 1624 using an adhesive of some kind.

FIG. 19 illustrates an embodiment of footwear component 1800 including transition zone 1650 that has been customized by a user. In this case, second portion 1632 of footwear component 1800 has a reverse layered structure, with intermediate layer 1702 comprising a second material that is sandwiched between upper layer 1622 and lower layer 1624 that are made of the first material.

In one embodiment, the second material may be substantially more rigid than the first material. In an exemplary embodiment, for example, the first material may be a nonwoven fabric and the second material may be TPU. This arrangement allows for different flexibility characteristics between first portion 1630 and second portion 1632.

Figure 20:
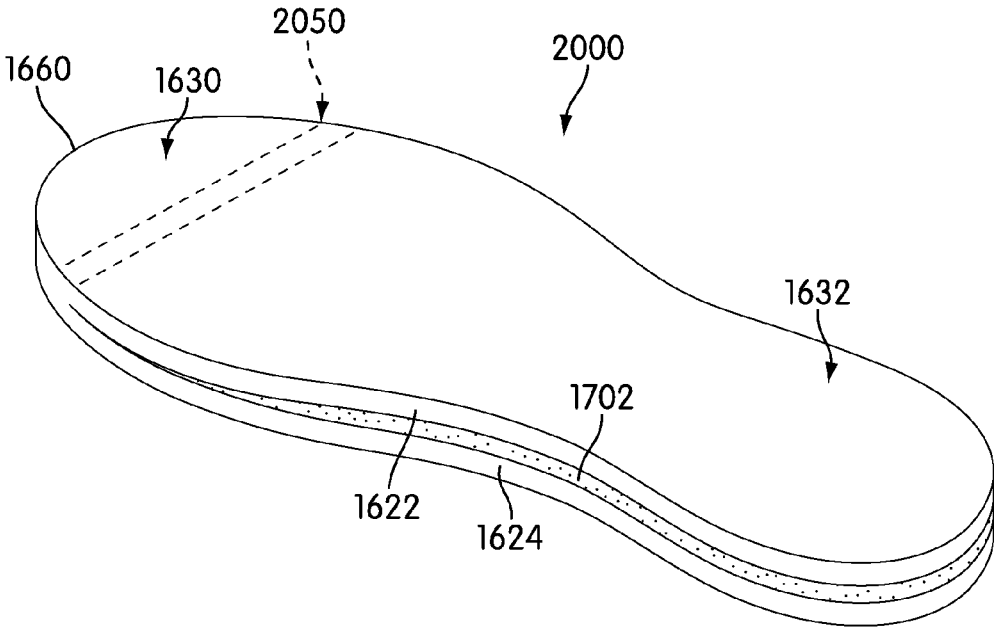
FIG. 20 is an isometric view of an embodiment of a footwear component with a transition zone disposed in a toe portion of the footwear component.

FIG. 20 illustrates an isometric view of another embodiment of footwear component 2000. In this case, footwear component 2000 includes a substantially similar structure to footwear component 1800 of the previous embodiment. In particular, footwear component 2000 includes first portion 1630 and second portion 1632. Second portion 1632 comprises upper layer 1622 and lower layer 1624. Furthermore, second portion 1632 includes intermediate layer 1702 that is disposed between upper layer 1622 and lower layer 1624.

As previously discussed, the location of a transition zone can be varied in different embodiments. Transition zone 2050 may be disposed between first portion 1630 and second portion 1632. In the current embodiment, transition zone 2050 is disposed in toe portion 1660 of footwear component 2000. In other words, transition zone 2050 is disposed substantially close to a forward most portion of footwear component 2000. Moreover, transition zone 2050 is disposed substantially forwards of the location of transition zone 1650 of the previous embodiment. With this arrangement, transition zone 2050 may provide for increased flexibility at toe portion 1660.

A footwear component can include provisions for modifying the flexibility and/or strength of different portions. In some cases, a footwear component could include an insert. In an exemplary embodiment, a footwear component may include an insert that is disposed in a layered portion of the footwear component.

Figure 21:
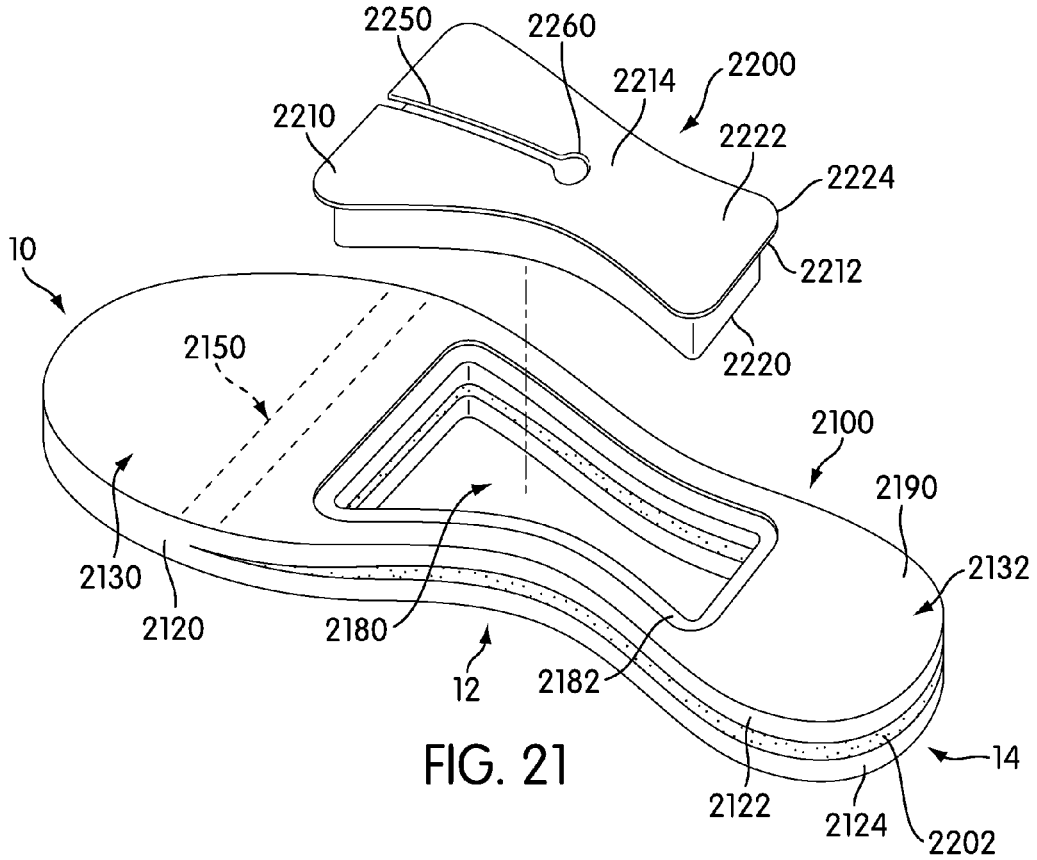
FIG. 21 is an isometric exploded view of an embodiment of a footwear component with an insert.
Figure 22:
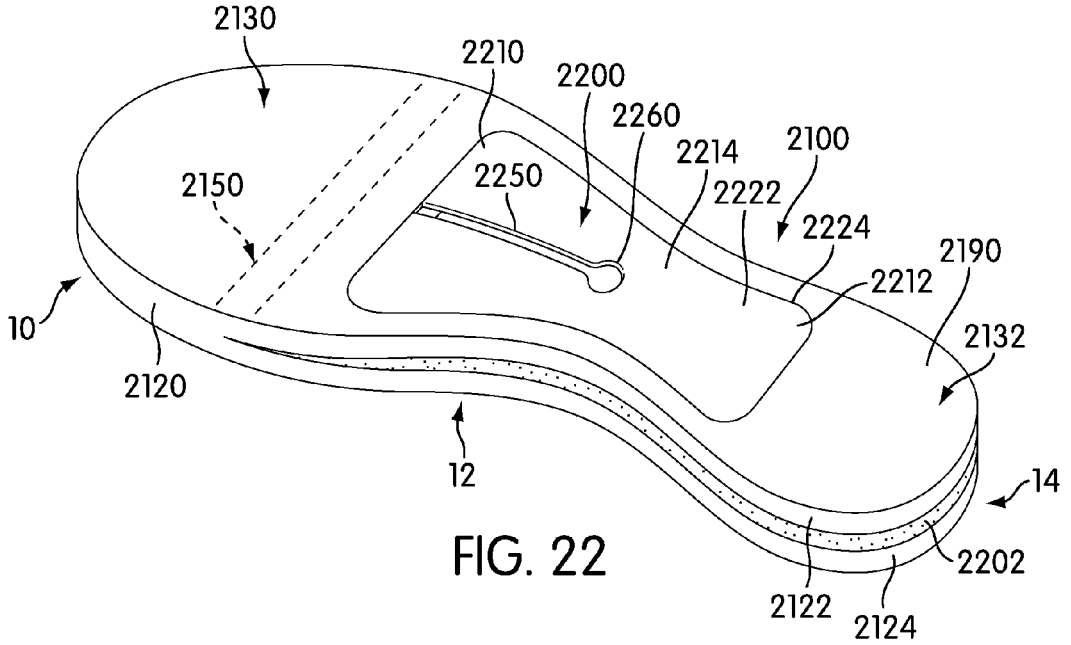
FIG. 22 is an isometric view of an embodiment of a footwear component with an insert.
Figure 23:
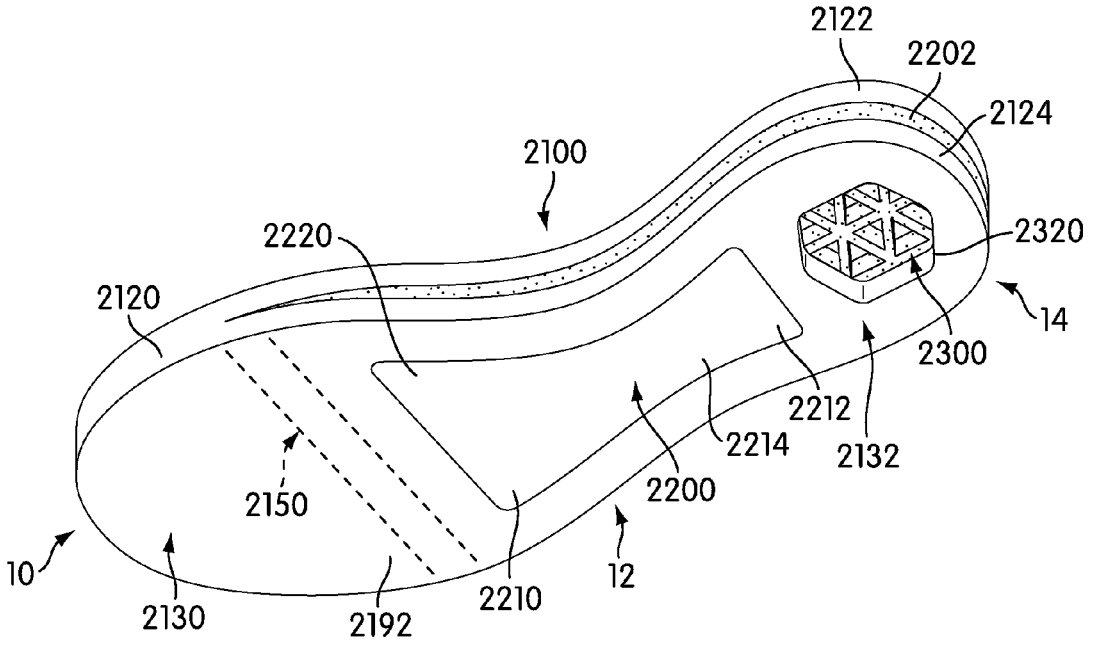
FIG. 23 is a bottom isometric view of an embodiment of a footwear component with an insert.

FIGS. 21 through 23 illustrate views of an embodiment of footwear component 2100. Footwear component 2100 may comprise flexible member 2120. Moreover, footwear component 2100 may be divided into first portion 2130 and second portion 2132. Second portion 2132 comprises upper layer 2122 and lower layer 2124. Furthermore, second portion 2132 includes intermediate layer 2202 that is disposed between upper layer 2122 and lower layer 2124. In this case, upper layer 2122 and lower layer 2124 are continuously formed with first portion 2130 to form flexible member 2120. In contrast, intermediate layer 2202 may comprise a substantially different material from flexible member 2120. First portion 2130 and second portion 2132 may be separated by transition zone 2150. In particular, flexible member 2120 is split at transition zone 2150 allowing for the insertion of intermediate layer 2202 in second portion 2132.

Footwear component 2100 may include insert 2200. Insert 2200 may include first portion 2210 and second portion 2212. Insert 2200 may also include intermediate portion 2214 that is disposed between first portion 2210 and second portion 2212. In some cases, first portion 2210 may extend into forefoot portion 10 and second portion 2212 may extend into heel portion 14. Furthermore, intermediate portion 2214 may extend through midfoot portion 12.

In different embodiments, the geometry of insert 2200 can vary. In the current embodiment, insert 2200 may have a geometry that is contoured to the shape of footwear component 2100. In particular, the width of insert 2200 may vary from first portion 2210 to second portion 2212 in a manner that corresponds to the varying width of footwear component 2100 between forefoot portion 10 and heel portion 14.

Insert 2200 can include base portion 2220 and top portion 2222. In some cases, top portion 2222 may be exposed on top surface 2190 of footwear component 2100. Base portion 2220 may extend downwardly from top portion 2222. In some cases, peripheral portion 2224 of top portion 2222 may extend outwardly from base portion 2220.

In some cases, second portion 2132 of footwear component 2100 may be configured with central cavity 2180 for receiving insert 2200. In some cases, base portion 2220 may be configured to insert into central cavity 2180, while top portion 2222 may be exposed on top surface 2190. In an exemplary embodiment, central cavity 2180 may be extend throughout the entire thickness of footwear component 2100 so that base portion 2220 of insert 2200 may be exposed on lower surface 2192 of footwear component 2100.

In an exemplary embodiment, central cavity 2180 may include peripheral ledge portion 2182 that is recessed with respect to top surface 2190. This arrangement allows top portion 2222 to fit down into peripheral ledge portion 2182 so that top portion 2222 may be approximately flush with top surface 2190. In other embodiments, however, top portion 2222 may extend upwardly from top surface 2190. In still other embodiments, top portion 2222 may be recessed with respect to top surface 2190.

In different embodiments, the materials used for insert 2200 could vary. In some cases, insert 2200 could be made of a relatively stiff material. For example, in some cases, insert 2200 could be made of a material with a rigidity that is substantially greater than the rigidity of second portion 2232 of footwear component 2100. In other cases, insert 2200 could be made of a relatively flexible material. For example, in some cases, insert 2200 could be made of a material that is substantially less rigid than second portion 2232 of footwear component 2100. In still another embodiment, insert 2200 could be made of a material having a substantially similar rigidity to the rigidity of second portion 2232. In other words, by varying the materials used for insert 2200 as well as the materials used for flexible portion 2120 and intermediate layer 2202, the relative rigidity of insert 2200 and second portion 2232 can be varied.

In one embodiment, upper layer 2122 and lower layer 2124 may be made of a first material, intermediate layer 2202 may be made of a second material and insert 2200 may be made of a third material. In some cases, the first material, the second material and the third material may all be substantially different materials. In one embodiment, the third material may be more rigid than the first material and the second material. This arrangement may help to increase the stiffness of second portion 2232. In another embodiment, the third material may be more rigid than the first material but less rigid than the second material. This arrangement may be used to increase the flexibility of second portion 2232. In still another embodiment, the third material could be less rigid than both the first material and the second material. It will be understood that an insert could also be used to vary other material characteristics of a footwear component.

In some embodiments, insert 2200 may include channel 2250. In some cases, channel 2250 may be a hollow channel that extends through top portion 2222 of insert 2200. Furthermore, in some cases, channel 2250 may extend through base portion 2220 of insert 2200 as well. In the current embodiment, channel 2250 may extend from first portion 2210 to intermediate portion 2214 of insert 2200. In addition, in the exemplary embodiment, channel 2250 may be connected to circular recess 2260 that is disposed in intermediate portion 2214. By varying the size, depth and shape of channel 2250, the flexibility and/or strength of insert 2200 can be further tuned to enhance the corresponding strength and/or flexibility of footwear component 2100. Furthermore, while the current embodiment includes a single channel, in other embodiments additional channels could also be used.

A footwear component can include provisions for reducing weight. In some embodiments, a footwear component can include one or more hollowed out portions. In some cases, hollowed out portions could be provided in a forefoot portion of a footwear component. In other cases, hollowed out portions could be provided in a midfoot portion of a footwear component. In an exemplary embodiment, hollowed out portions could be provided in a heel portion of a footwear component.

Figure 24:
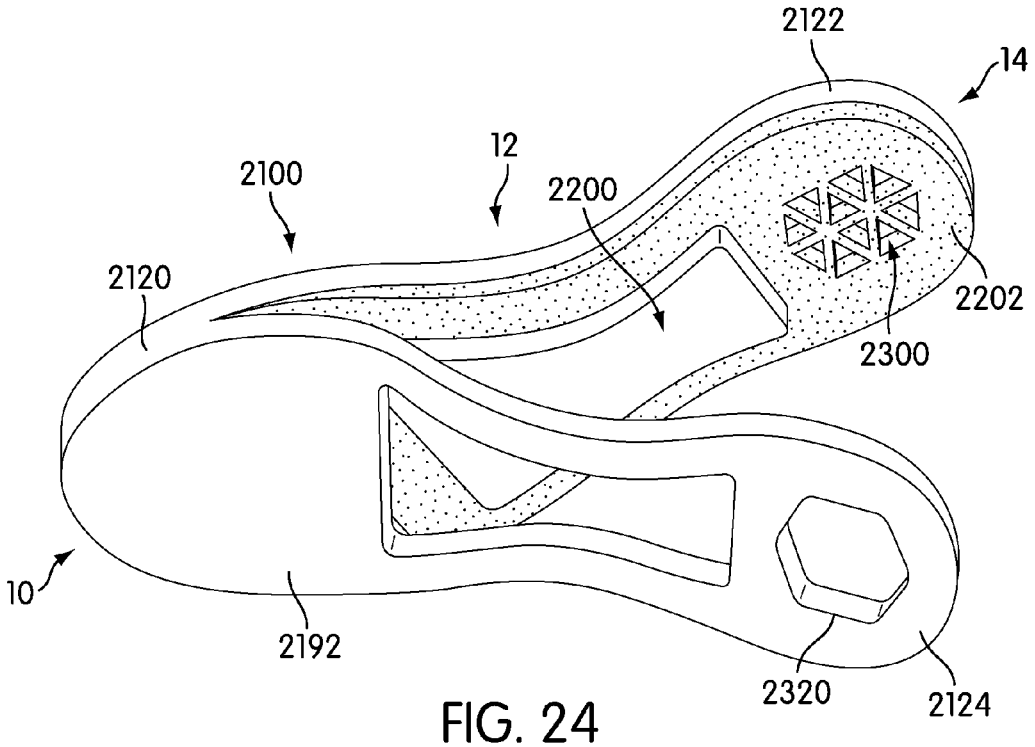
FIG. 24 is a bottom isometric view of an embodiment of a footwear component with an insert.

Referring now to FIGS. 23 and 24, in some embodiments, footwear component 2100 could be configured with hollowed out portion 2300. Hollowed out portion 2300 may be disposed in heel portion 14. In the current embodiment, hollowed out portion 2300 may be visible through hole 2320 of lower layer 2124. In some cases, hollowed out portion 2300 may comprise a plurality of cavities where material has been removed from intermediate portion 2202. Hollowed out portion 2300 can be configured in any shape including, but not limited to: rounded shapes, rectangular shapes, triangular shapes, polygonal shapes, regular shapes, irregular shapes as well as any other kinds of shapes. Furthermore, in some cases, multiple cavities in a hollowed out portion may be arranged in a manner that provides a lattice like structure for the hollowed out portion. In the exemplary embodiment, hollowed out portion 2300 may comprise a plurality of triangular shaped cavities that are arranged in a lattice like configuration.

It will be understood that hollowed out portion 2300 is optional and may not be included in all embodiments. Furthermore, the number and location of hollowed out portions can vary from one embodiment to another. Although the current embodiment includes hollowed out portion 2300 disposed in heel portion 14 of footwear component 2100, other embodiments could include one or more hollowed out portions in any other locations of footwear component 2100. Also, while hollowed out portion 2300 is visible through hole 2320 in the current embodiment, in other embodiments, hollowed out portion 2300 may not be visible.

An insert can be formed in any manner. In some cases, an insert could be formed using a molding process. In particular, a cavity may be formed within a portion of a footwear component and the insert could be molded to fit into the cavity. In other cases, an insert could be a stock fit component that is configured to fit into a pre-formed cavity of the footwear component. In still other cases, an insert could be formed in any other manner.

Figure 25:
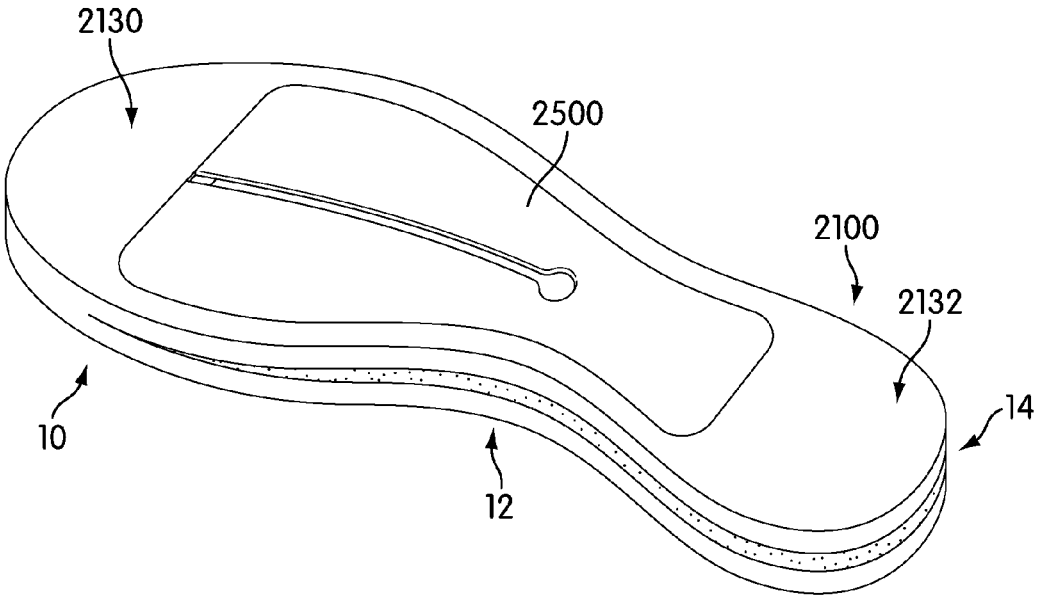
FIG. 25 is an isometric view of an embodiment of a footwear component with an insert configured to extend through a majority of a forefoot portion of the footwear component.

FIG. 25 illustrates an isometric view of another embodiment of insert 2500 that may be used with footwear component 2100. In this embodiment, insert 2500 has a substantially longer shape than insert 2200 of the previous embodiment. In particular, insert 2500 may extend through a majority of forefoot portion 10. In some cases, to accommodate the length of insert 2500, the length of second portion 2132 can be increased. In other cases, however, insert 2500 could extend into first portion 2130. With this arrangement, insert 2500 can be used to fine tune the flexibility and/or strength of a majority of forefoot portion 10 of footwear component 2100. It will also be understood that in other embodiments, an insert could be configured with any other dimensions. In particular, the length, width and thickness could be adjusted in any manner.

Figure 26:
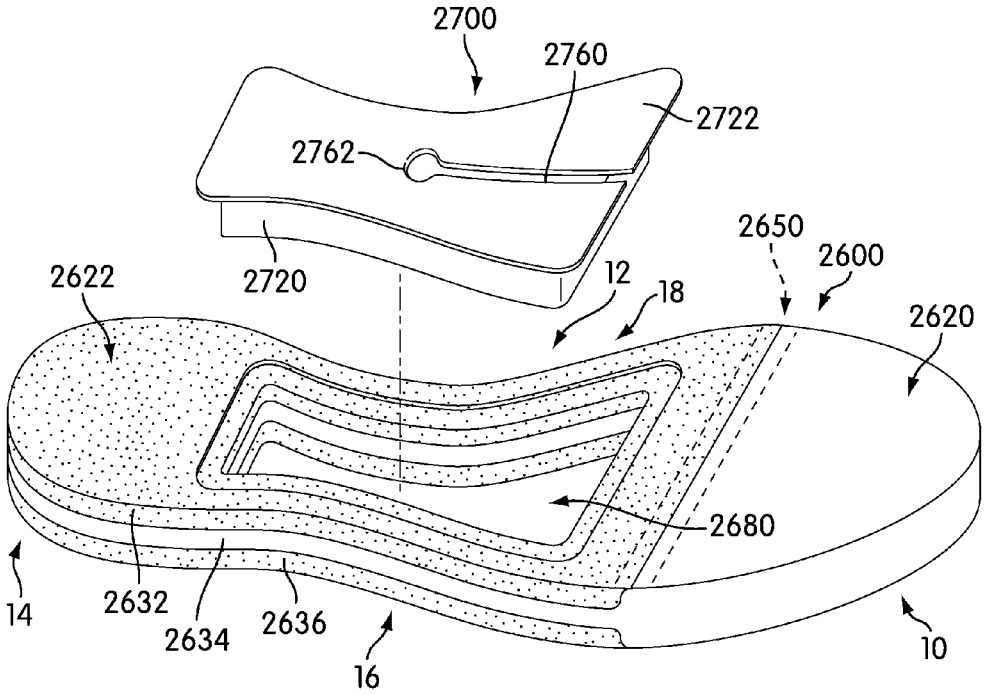
FIG. 26 is an isometric exploded view of an embodiment of a footwear component with an insert.
Figure 27:
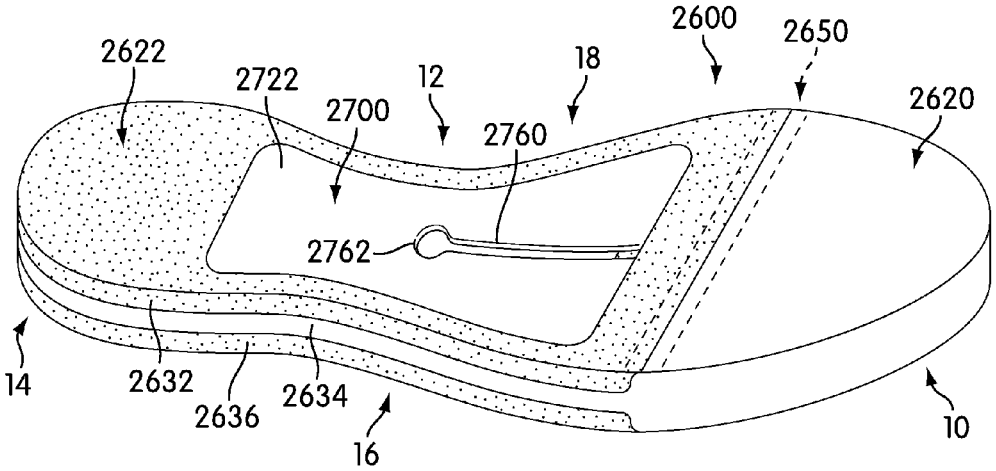
FIG. 27 is an isometric view of an embodiment of a footwear component with an insert.

FIGS. 26 and 27 illustrate isometric views of another embodiment of footwear component 2600 including insert 2700. In this embodiment, footwear component 2600 includes first portion 2620 and second portion 2622 that is disposed rearwardly of first portion 2620 in the longitudinal direction. In some cases, first portion 2620 may have a first rigidity and second portion 2622 may have a second rigidity. In one embodiment, first portion 2620 may be substantially less rigid than second portion 2622. In other words, first portion 2620 may be substantially more flexible than second portion 2622. In other embodiments, however, second portion 2622 may be less rigid than first portion 2620.

In one embodiment, first portion 2620 may comprise a substantially monolithic portion. In contrast, second portion 2622 may comprise a substantially layered portion. In some cases, second portion 2622 may comprise upper layer 2632, lower layer 2636 and intermediate layer 2634 that is disposed between upper layer 2632 and lower layer 2636. In some cases, upper layer 2632 may be proximal to intermediate layer 2634 and lower layer 2636. Likewise, intermediate layer 2634 may be proximal to lower layer 2636. With this arrangement, lower layer 2636 may be disposed closer to a ground engaging surface, while upper layer 2632 may be disposed closer to a foot.

First portion 2620 and second portion 2622 may be generally connected at transition zone 2650. In particular, transition zone 2650 is a zone where the flexibility of footwear component 2600 changes substantially between first portion 2620 and second portion 2622. Transition zone 2650 generally extends between lateral side 16 and medial side 18 and has small width extending approximately in the longitudinal direction. In other words, the flexibility and/or rigidity characteristics of footwear component 2600 may change gradually between first portion 2620 and second portion 2622 across the width of transition zone 2650.

Insert 2700 may be substantially similar to insert 2200 of the previous embodiment. In particular, insert 2700 may comprise base portion 2720 and top portion 2722. In addition, in some cases, insert 2700 may include channel 2760 that extends through top portion 2222, as well as circular recess 2762. Furthermore, second portion 2622 of footwear component 2600 may include central cavity 2680 for receiving insert 2700. With this arrangement, insert 2700 may used to fine tune the flexibility and/or strength of second portion 2622 of footwear component 2600.

In some embodiments, an insert could be removable by a user of an article of footwear. In some cases, a user may be provided with two or more different inserts having different material characteristics. A user could then interchange one insert with another insert in order to vary the properties of a footwear component.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A lasting board for an article of footwear, comprising:
a forefoot portion, a midfoot portion, and a heel portion;
the lasting board comprising a first material and a second material that is different from the first material;
the forefoot portion being constructed of the first material and being substantially monolithic;
the midfoot portion and the heel portion comprising an upper layer, an intermediate layer and a lower layer;
the intermediate layer being constructed of the first material and the upper layer and the lower layer being constructed of the second material;
wherein the forefoot portion is substantially more flexible than the midfoot portion and the heel portion;
the midfoot portion and the heel portion comprising a central cavity that extends through the upper layer, the intermediate layer, and the lower layer;
an insert configured for insertion into the central cavity; and wherein the insert comprises a third material that is substantially different from the first material and substantially the same as the second material.

2. The lasting board according to claim 1, wherein the second material is substantially more rigid than the first material.

3. The lasting board according to claim 2, wherein the forefoot portion and the midfoot portion are connected at a transition zone.

4. The lasting board according to claim 1, wherein the forefoot portion and the midfoot portion are connected at a transition zone.

5. The lasting board according to claim 4, wherein the transition zone has a linear configuration.

6. The lasting board according to claim 1, wherein the third material is substantially more rigid than the first material.

7. The lasting board according to claim 1, wherein the third material is substantially less rigid than the first material.

8. The lasting board according to claim 1, wherein the insert has a geometry contoured to the shape of the lasting board.

9. The lasting board according to claim 8, wherein the insert has a width that corresponds to the varying width of the lasting board.

10. The lasting board according to claim 9, wherein the insert has a top portion and a base portion extending downwardly from the top portion.

11. The lasting board according to claim 1, wherein the insert has a top portion and a base portion extending downwardly from the top portion.

12. The lasting board according to claim 11, wherein the base portion of the insert is configured to insert into the central cavity.

13. The lasting board according to claim 12, wherein the central cavity includes a peripheral ledge portion recessed with respect to a top surface of the lasting board.

14. The lasting board according to claim 13, wherein the top portion of the insert has a peripheral portion extending outwardly from the base portion.

15. The lasting board according to claim 14, wherein the insert includes a hollow channel that extends through the top portion of the insert.

16. The lasting board according to claim 14, wherein the peripheral portion of the insert fits into the peripheral ledge portion of the lasting board.

17. The lasting board according to claim 16, wherein the insert is approximately flush with a top surface of the lasting board.

18. The lasting board according to claim 17, wherein the insert includes a hollow channel that extends through the top portion of the insert.

19. The lasting board according to claim 16 wherein the insert is approximately flush with a bottom surface of the footwear component.

20. The lasting board according to claim 1, wherein the insert includes a hollow channel that extends through the top portion of the insert.

* * * * *